US006238236B1

(12) United States Patent
Craft, Jr.

(10) Patent No.: US 6,238,236 B1
(45) Date of Patent: May 29, 2001

(54) STRESS RELIEF APPARATUS FOR AN ELECTRICAL CONDUCTOR

(75) Inventor: Thomas Francis Craft, Jr., Hackettstown, NJ (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/162,218

(22) Filed: Sep. 28, 1998

(51) Int. Cl.[7] ..... H01R 11/20

(52) U.S. Cl. ..... 439/425; 439/369; 439/445; 439/460; 439/725

(58) Field of Search ..... 439/472, 387, 439/460, 463, 468, 725, 425, 426, 369, 445, 448, 454, 455

(56) References Cited

U.S. PATENT DOCUMENTS

| | | | | |
|---|---|---|---|---|
| 2,587,239 | * | 2/1952 | Smith | 439/425 |
| 3,376,543 | * | 4/1968 | Hammel . | |
| 3,745,228 | * | 7/1973 | Vogt | 174/88 |
| 3,864,011 | * | 2/1975 | Huber | 339/103 |
| 3,874,762 | * | 4/1975 | Shott et al. | 339/91 |
| 4,516,822 | * | 5/1985 | Wolfel | 339/103 |
| 4,606,596 | | 8/1986 | Whiting et al. | 339/107 |
| 4,749,369 | * | 6/1988 | Wang | 439/459 |
| 5,055,065 | * | 10/1991 | Pearl | 439/425 |
| 5,178,559 | | 1/1993 | Mello | 439/472 |
| 5,509,100 | | 4/1996 | Garnett et al. | 385/136 |
| 5,553,787 | * | 9/1996 | Guginsky | 439/472 |
| 5,620,334 | | 4/1997 | Quillet et al. | 439/471 |
| 5,653,609 | * | 8/1997 | Orstad et al. | 439/472 |

* cited by examiner

*Primary Examiner*—Hien Vu
*Assistant Examiner*—Truc Nguyen
(74) *Attorney, Agent, or Firm*—Duane Morris & Heckscher, LLP; Steven E. Koffs

(57) ABSTRACT

A stress relief apparatus includes a base having a plurality of pins projecting from the base in an axial direction. The pins may have different lengths to accommodate a conductor. Alternatively, spring loaded pins may be used to accommodate the conductor. Spring loaded pins of a common length may be used. The base having a plurality of slots. The base can be mounted to a mounting surface of a printed circuit board or other electrical system. A clip has an engaging surface normal to the axial direction. A latch is attached to the clip. The latch is received by any one of the plurality of slots for detachably mounting the clip to the base in any one of a plurality of heights. Each height provides a respectively different distance between the pins and the engaging surface, such that any one of a plurality of differently sized conductors is gripped between the pins and the engaging surface when the clip is attached to the base, so as to provide stress relief. In one example, the pins are formed of a conductive material, and at least one of the pins projects from a bottom surface of the base for forming an electrical connection between the conductor and a printed circuit board.

18 Claims, 4 Drawing Sheets

STRESS RELIEF APPARATUS FOR AN ELECTRICAL CONDUCTOR

FIELD OF THE INVENTION

The present invention relates to electrical systems generally, and more specifically to stress relief apparatus for electrical conductors such as wires and cables.

DESCRIPTION OF THE RELATED ART

Many electrical systems require a stress relief mechanism to be used for wires that connect components together. The stress relief mechanism prevents a tensile load on a wire from being transmitted to the device to which the wire is connected. In some instances, the stress relief prevents the wire from becoming disconnected from the device. In other configurations, the stress relief prevents damage to the device to which the wire is connected.

Common types of stress relief in the electrical arts include: (1) a clamp member that is attached to a housing or junction box by a screw or similar fastener; (2) wire saddles; (3) tie wraps; and (4) a pair of members in a "U" or "V" shaped to grip the conductor by an interference fit.

Many product design specifications require that the conductors or cables satisfy a minimum cable pull out force criterion. This may be difficult to achieve with the above-listed stress relief devices. Although the screw-mounted clamp member can satisfy a minimum pull out force requirement, it requires a tool, takes a relatively long time to install, and is liable to damage a cable if too much torque is applied to the screw. It is more difficult to ensure that the minimum pull out force requirement is satisfied with the other three types of stress relief apparatus listed above.

An improved stress relief apparatus is desired.

SUMMARY OF THE INVENTION

The present invention is an apparatus for relieving stress in a cable, including a base having a plurality of pins projecting from the base, in an axial direction; and a clip, detachably mounted on the base, the clip having an engaging surface normal to the axial direction, such that the cable is gripped between the pins and the engaging surface when the clip is attached to the base, to provide stress relief.

These and other aspects of the invention are described below with reference to the drawings and the exemplary embodiments.

DETAILED DESCRIPTION

Figure 1:
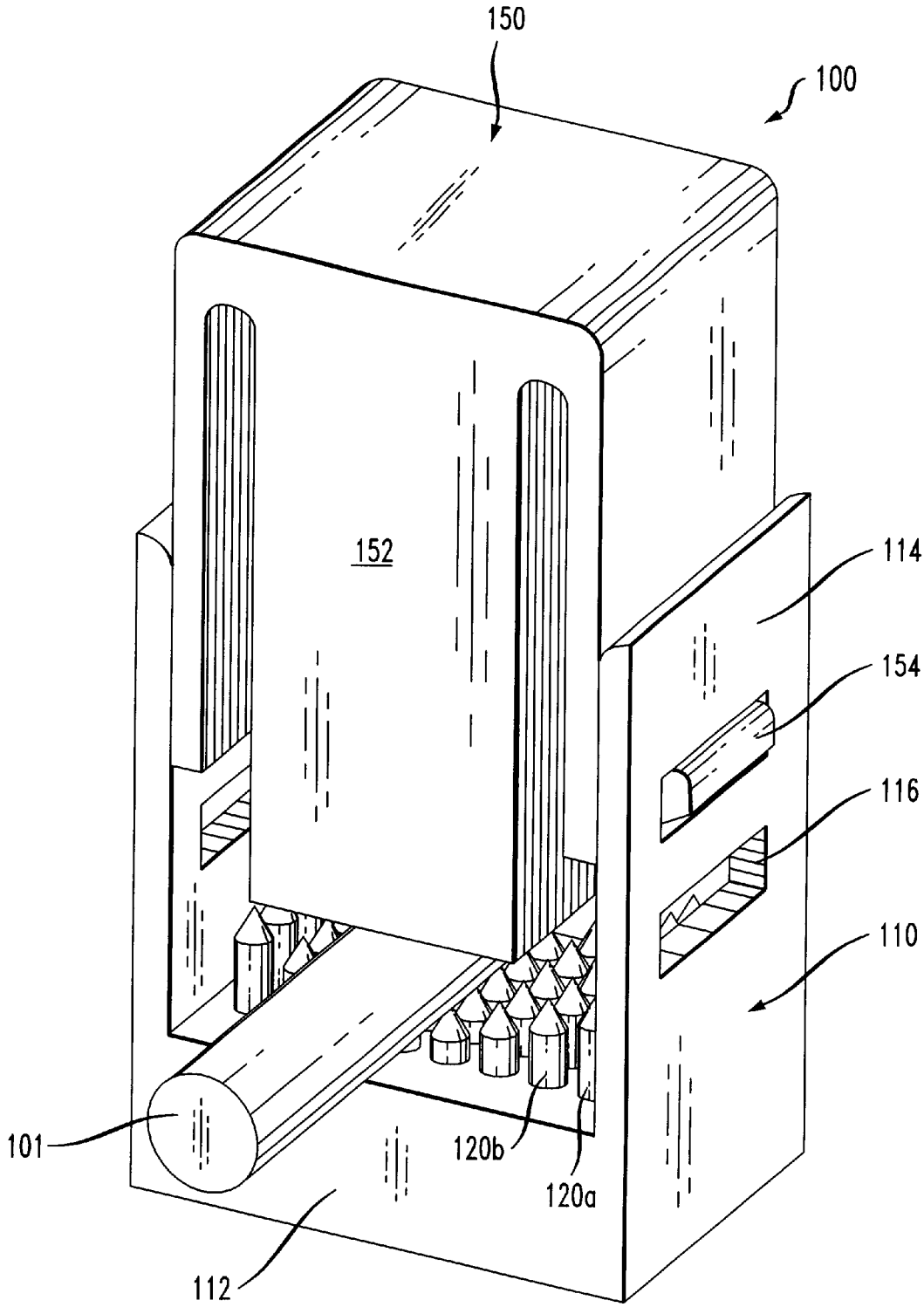
FIG. 1 is an isometric view of an exemplary stress relief apparatus according to the present invention.
Figure 3:
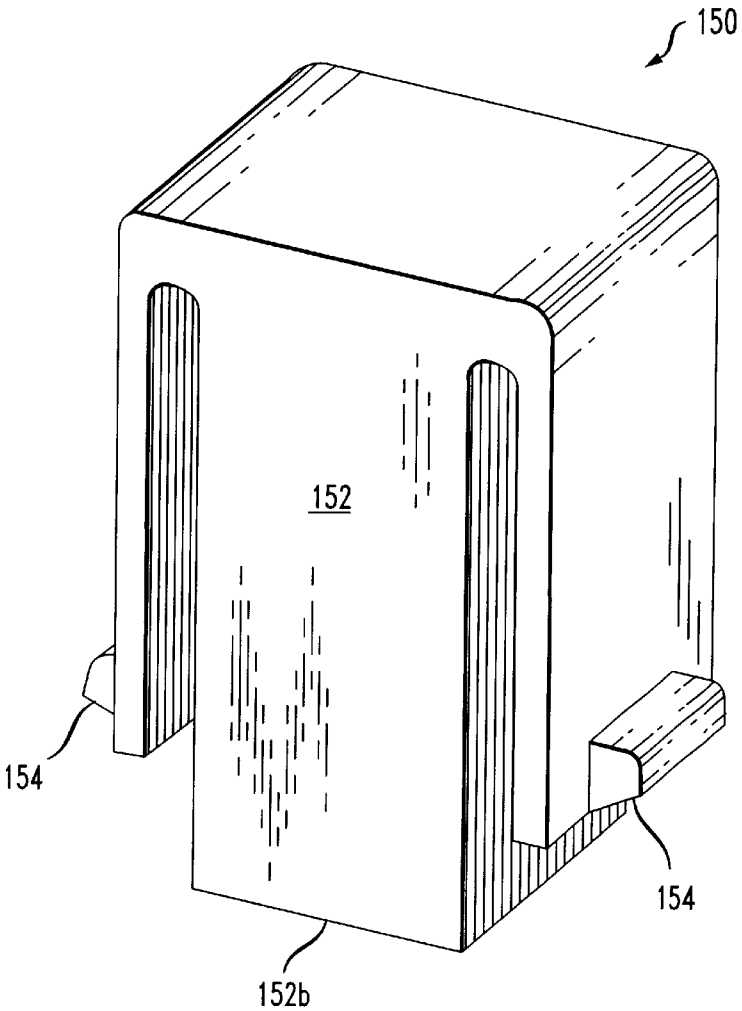
FIG. 3 is an isometric view showing the clip of FIG. 1.
Figure 2:
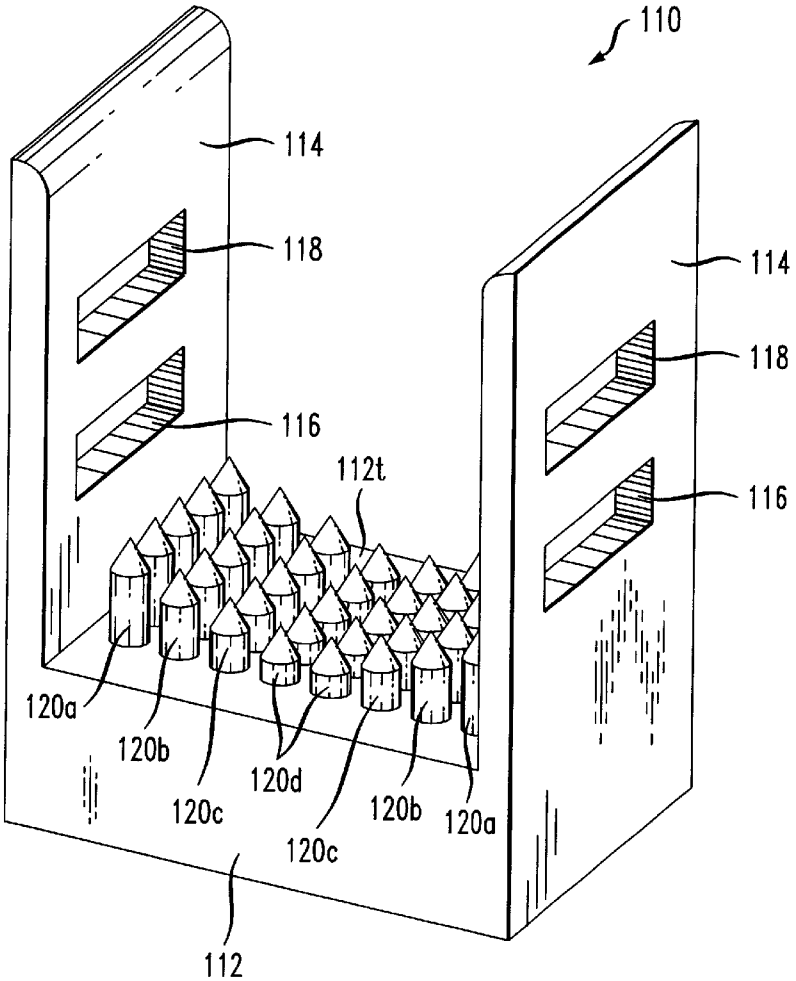
FIG. 2 is an isometric view showing the base of FIG. 1.

FIGS. 1–3 show an exemplary apparatus 100 for relieving stress in a conductor 101. The apparatus includes two major components: a base having first means for gripping the conductor on a surface of the base; and second means for gripping the conductor. The second gripping means are detachably mounted to the base. The first and second gripping means compress the conductor and prevent longitudinal movement by the conductor, thereby providing stress relief. The first and second gripping means may be, for example, a base 110 and a clip 150 for gripping the conductor 101.

The exemplary base has three portions: a middle portion 112 and two side portions 114. The base 110 has the first gripping means, which may be a plurality of pins 120*a*–120*d* projecting from the middle section 112. in an axial direction. In the exemplary base of FIG. 2, the pins have respectively different lengths to accommodate the conductor 101. The pins may decrease in length from the longest pins 120*a* on the left and right to the shortest pins 120*d* in the center. Further, the pins may have patterns of varying lengths to accommodate multiple wires or cables within a single base-clip configuration. Thus, a contour passing through the tips of the pins may have a corresponding concavity for each respective wire or cable.

The base 110 has a plurality of slots 116, 118 which are shaped to receive corresponding latches 154 on the clip 150. Thus, the clip 150 is attachable to the base 110 in any one of a plurality of heights. Each height provides a respectively different distance between the pins 120*a*–120*d* and the engaging surface 152*b*. This allows the apparatus to accommodate differently sized conductors 101, and still provide positive force for engaging the conductor 101 between the pins 120*a*–120*d* and the engaging surface 152*b* of clip 150.

Although the example shows the slots 116, 118 on the base 110 and the latches 154 on the clip 150, one of ordinary skill can readily appreciate that the latches may be positioned on the side members 114 of the base 110, and the mating slots may be located on the clip.

FIG. 3 shows an exemplary clip 150. The clip 150 is detachably mounted on the base 110. The clip 150 has an engaging surface 152*b* normal to the axial direction of the pins 120*a*–120*d*. The engaging surface 152*b* of the clip 150 provides the second gripping means. The engaging surface 152*b* may be flat, or the engaging surface may have grooves, ridges, lands, knurling, or other textured surface.

The conductor 101 is gripped between the pins 120*a*–120*d* and the engaging surface 152*b* when the clip 150 is attached to the base 110, thereby to provide stress relief.

The base 110 and clip 150 may both be formed of an insulating polymer material. Exemplary materials are polypropylene and polycarbonate. Other polymers and insulators may also be used. If fixed length pins are used (such as in FIG. 1), then the pins may be formed by molding at the same time as the base 110. If spring loaded pins are used, then the base is formed with a plurality of holes (not shown) for receiving the spring loaded pins, and the pins may be automatically inserted by machine.

Although FIGS. 1–3 show an example in which the center pins 120*d* are shorter than the outer pins 120*a*, and the engaging surface 152*b* is flat, one of ordinary skill in the art recognizes that substantially the same result is achieved by using a plurality of pins having the same length, and an engaging surface that is concave to accommodate the conductor 101.

Figure 4:
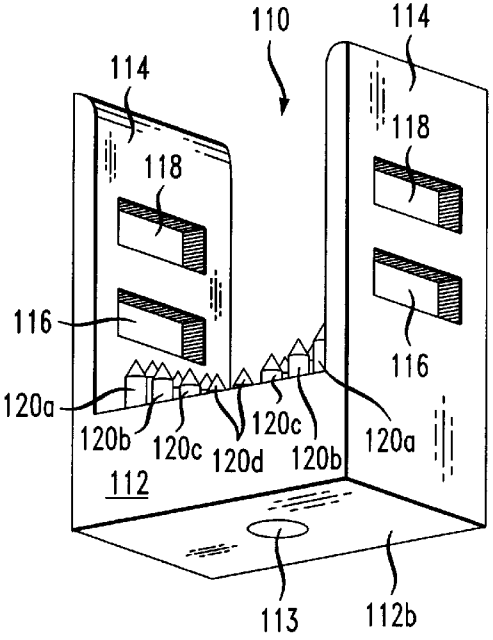
FIG. 4 is an isometric view showing the bottom of the base of FIG. 2.

FIG. 4 shows that the base 110 includes means for fastening the base to a mounting surface of a PC board, or other apparatus in which the stress relief apparatus 100 may be used. The fastening means may be a hole 113 for a conventional fastener, such as a screw, rivet, or other suitable fastener. Other mounting means known to those skilled in the art may also be used.

Figure 5:
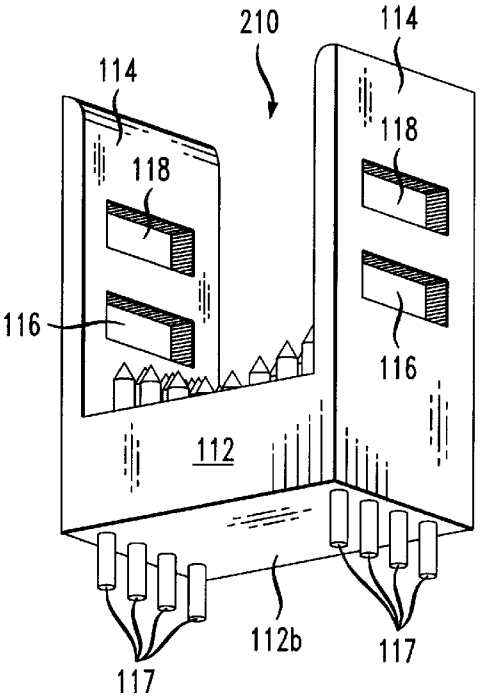
FIG. 5 is an isometric view showing a variation of the base of FIG. 4.

FIG. 5 shows a variation of the base 210. In base 210, at least some of the pins are formed of a conductive material, and at least one of the pins 117 projects from a bottom surface 112*b* of the base, for connecting to a printed circuit board or ground conductor. In FIG. 5, two rows of conductive pins 117 project from the bottom of the base 152*b*. These two rows of pins 117 may serve the dual purposes of: (1) forming an electrical connection between the conductor 101 and a circuit, PCB, or ground, and (2) providing support to hold the base 210 in place without additional fasteners. Other features of the base 210 having the same structure as the base 110 described above are identified by the same reference numerals as shown in FIG. 1, and for brevity, a description of these features is not repeated herein.

Figure 6:
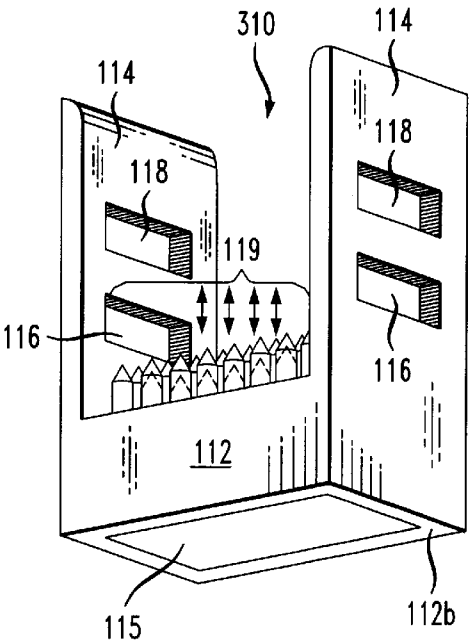
FIG. 6 is an isometric view showing another variation of the base of FIG. 4.

FIG. 6 shows a further variation of the base 310. The pins may be spring loaded pins, commonly referred to as "pogo pins." FIG. 6 shows an example in which spring loaded pins 119 are used. As shown in FIG. 6, the spring loaded pins 119 may all have the same length. The center pins are compressed by the conductor (the center pins are shown in the retracted position in phantom in FIG. 6). The use of spring loaded pins 119 provides greater flexibility in accommodating conductors having many different sizes. FIG. 6 also shows a region of an adhesive 115, that may be used to fasten the base to a variety of apparatus. A conventional adhesive may be used for this purpose. Other features of the base 310 having the same structure as the base 110 described above are identified by the same reference numerals as shown in FIG. 1, and for brevity, a description of these features is not repeated herein.

Although FIGS. 1–3 show the pins 120*a*–120*d* mounted on the base 110, and the engaging surface 152*b* is on the clip 152, one of ordinary skill recognizes that the pins may be mounted on the bottom surface 152*b* of the clip, and the top surface 112*t* of the base may be a smooth engaging surface or a textured surface (having grooves, ridges, lands, knurling or the like).

Figure 7B:
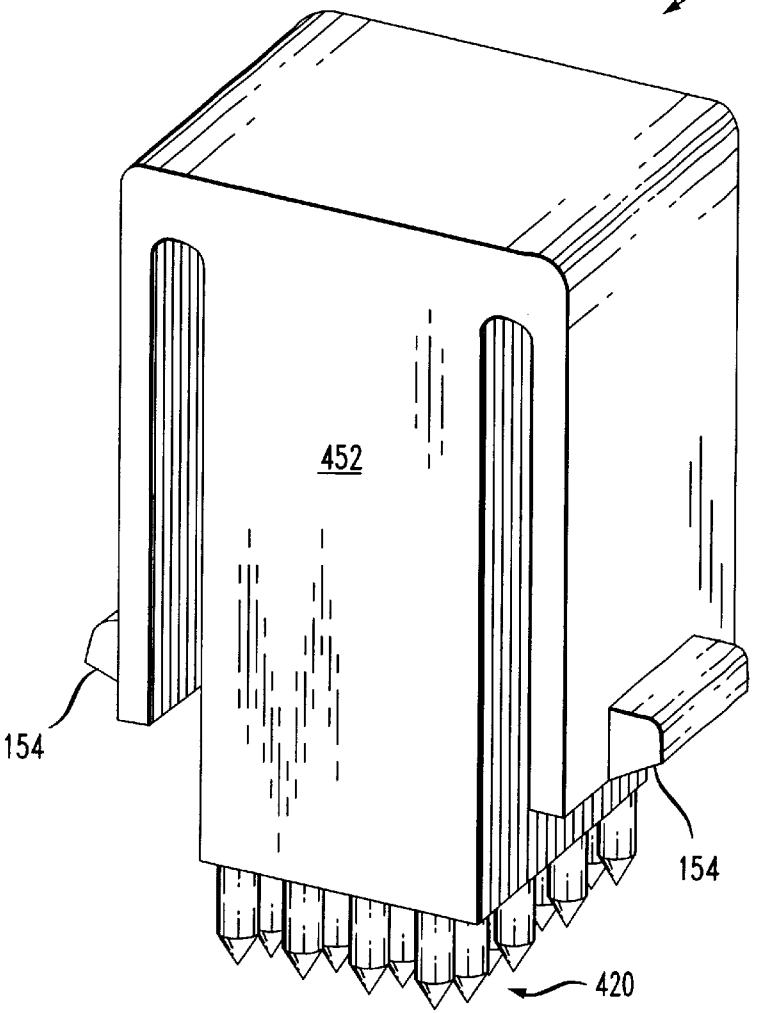
FIGS. 7A and 7B are isometric views showing another variation of the exemplary embodiment.
Figure 7A:
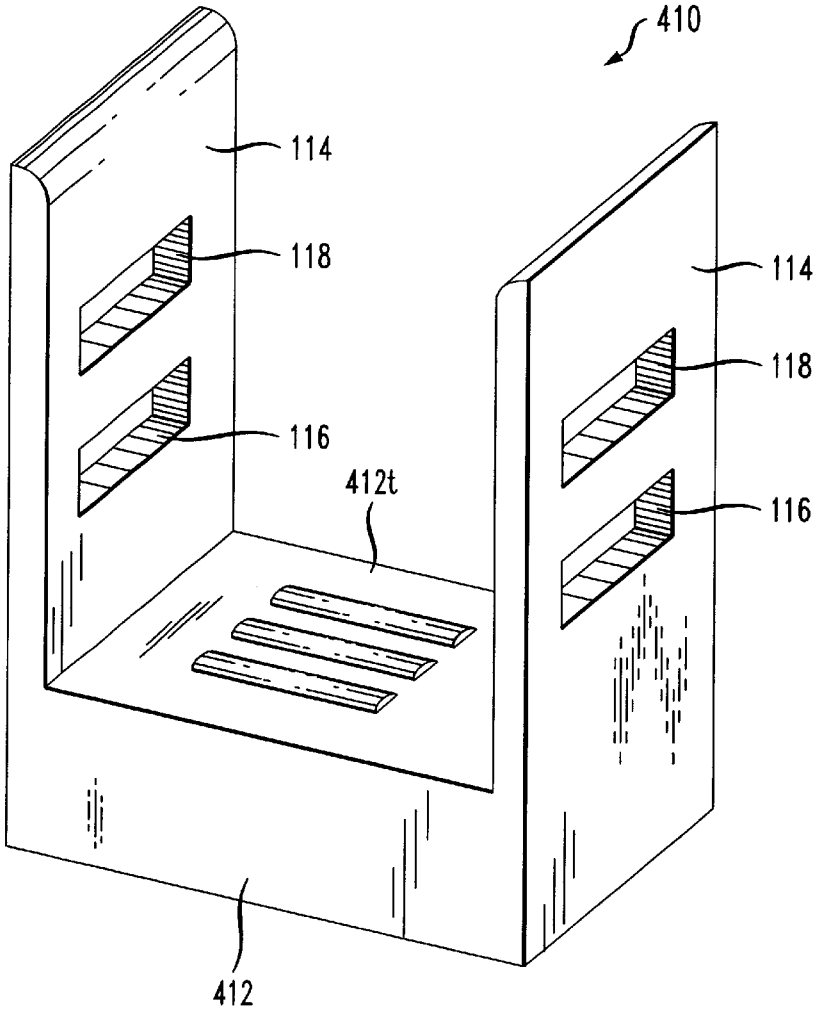

FIGS. 7A and 7B show a variation of the base 410 and clip 450 intended for use together with each other. In FIGS. 7A and 7B, the pins 420 are mounted on the bottom of the clip 450. In FIGS. 7A and 7B, the first gripping means on the base 410 is a plurality of ridges 413 on surface 412*t* of base portion 412, for gripping the bottom of the conductor 101. Other textured surfaces (having grooves, lands, knurling or the like) may be used for the first gripping means. The second gripping means is the plurality of pins 420 on the body 452 of clip 450. The pins shown in FIG. 7 are of about the same length and may be spring loaded. Alternatively, the pins may be shorter in the middle, similar to the pins 120*a*–120*d* of FIG. 1. Other features of the base 410 and clip 450 having the same structure as the base 110 and clip 150 described above are identified by the same reference numerals as shown in FIGS. 1–3, and for brevity, a description of these features is not repeated herein.

A stress relief apparatus according to the exemplary embodiments of the invention described above provides a positive stop for conductors and cables of various sizes. If desired, the apparatus may also perform a grounding function as described above with reference to FIG. 5., a function that prior art devices such as cable wraps could not provide. The apparatus may also include a positive force latching feature as described above with reference to FIGS. 2 and 3 to secure the conductor or cable. These and other features of the exemplary embodiments are readily recognized by those of ordinary skill in the art.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. Apparatus for relieving stress in an electrical connection of a conductor, comprising:

a base having a plurality of pins projecting therefrom, in an axial direction, the pins having respectively different lengths to accommodate the conductor;

a clip, detachably mounted on the base, the clip having an engaging surface normal to the axial direction, such that the conductor is gripped between the pins and the engaging surface when the clip is attached to the base, with the pins directly contacting the conductor, thereby to provide stress relief to the electrical connection, wherein the clip is attached to the base by a latch;

wherein the clip is attachable to the base in any one of a plurality of heights, each height providing a respectively different distance between the pins and the engaging surface, thereby to accommodate respectively different conductor sizes.

2. Apparatus according to claim 1, wherein the pins are formed of a conductive material, and at least one of the pins projects from a bottom surface of the base.

3. Apparatus according to claim 1, wherein the base includes means for fastening the base to a mounting surface.

4. Apparatus for relieving stress in an electrical connection of a conductor, comprising:

a base having a plurality of spring loaded pins projecting therefrom, in an axial direction; and a clip, detachably mounted on the base, the clip having an engaging surface normal to the axial direction, such that the conductor is gripped between the pins and the engaging surface when the clip is attached to the base, thereby to provide stress relief to the electrical connection.

5. Apparatus for relieving stress in an electrical connection of a conductor, comprising:

a base having a plurality of pins projecting therefrom, in an axial direction, wherein the pins have respectively different lengths to accommodate the conductor; and means for gripping the conductor, detachably mounted to the base, the pins and gripping means compressing the conductor and preventing longitudinal movement by the conductor, thereby to provide stress relief to the electrical connection.

6. Apparatus for relieving stress in an electrical connection of a conductor, comprising:

a base having a plurality of pins projecting therefrom, in an axial direction, wherein at least one of the pins is formed of a conductive material and projects from a bottom surface of the base; and means for gripping the conductor, detachably mounted to the base, the pins and gripping means compressing the conductor and preventing longitudinal movement by the conductor, thereby to provide stress relief to the electrical connection, wherein the pins which do not project from the bottom surface are spring loaded pins.

7. Apparatus for relieving stress in an electrical connection of a conductor, comprising:

a base having a plurality of pins projecting therefrom, in an axial direction, wherein at least one of the pins projects from a bottom surface of the base; and means for gripping the conductor, detachably mounted to the base, the pins and gripping means compressing the conductor and preventing longitudinal movement by the conductor, thereby to provide stress relief to the electrical connection, wherein the gripping means is attachable to the base in any one of a plurality of heights, each height providing a respectively different distance between the base and gripping means, thereby to accommodate respectively different conductor sizes.

8. Apparatus according to claim 7, further comprising a latch connected to the gripping means, wherein the base has a plurality of slots for receiving the latch, each slot corresponding to a respective one of the plurality of heights.

9. Apparatus for relieving stress in a conductor, comprising:

a base having a plurality of slots; and a clip;

one of the group consisting of the base and the clip having a plurality of pins projecting therefrom in an axial direction, wherein the pins are either spring loaded or have respectively different lengths to accommodate the conductor;

the other of the group consisting of the base and the clip having an engaging surface normal to the axial direction, and a latch attached to the clip, the latch being received by any one of the plurality of slots for detachably mounting the clip to the base in any one of a plurality of heights, each height providing a respectively different distance between the pins and the engaging surface, such that any one of a plurality of differently sized conductors is gripped between the pins and the engaging surface with the pins directly contacting the conductor without piercing the conductor, when the clip is attached to the base, thereby to provide stress relief.

10. Apparatus for relieving stress in a conductor, comprising:

a base having a plurality of pins projecting therefrom in an axial direction, wherein the pins have respectively different lengths to accommodate the conductor, the base having a plurality of slots;

a clip having an engaging surface normal to the axial direction; and a latch attached to the clip, the latch being received by any one of the plurality of slots for detachably mounting the clip to the base in any one of a plurality of heights, each height providing a respectively different distance between the pins and the engaging surface, such that any one of a plurality of differently sized conductors is gripped between the pins and the engaging surface without piercing the conductor, when the clip is attached to the base, thereby to provide stress relief.

11. Apparatus according to claim 10, wherein the base includes means for fastening the base to a mounting surface.

12. Apparatus according to claim 11, wherein the fastening means include one of the group consisting of a mechanical fastener and an adhesive.

13. Apparatus for relieving stress in a conductor, comprising:

a base having a plurality of spring loaded pins projecting therefrom in an axial direction, the base having a plurality of slots;

a clip having an engaging surface normal to the axial direction, a latch attached to the clip, the latch being received by any one of the plurality of slots for detachably mounting the clip to the base in any one of a plurality of heights, each height providing a respectively different distance between the pins and the engaging surface, such that any one of a plurality of differently sized conductors is gripped between the pins and the engaging surface when the clip is attached to the base, thereby to provide stress relief.

14. Apparatus according to claim 1, wherein the pins decrease in length from the outermost pins to the shortest pins in the center.

15. Apparatus according to claim 5, wherein the pins decrease in length from the outermost pins to the shortest pins in the center.

16. Apparatus according to claim 10, wherein the pins decrease in length from the outermost pins to the shortest pins in the center.

17. Apparatus according to claim 9, wherein the base has a textured surface.

18. Apparatus according to claim 17, wherein the base has a plurality of ridges arranged in a direction normal to the pins and normal to an axis of the conductor, for gripping a bottom of the conductor.

* * * * *